United States Patent [19]

Malfit

[11] Patent Number: 4,781,552

[45] Date of Patent: Nov. 1, 1988

[54] HIGH PRESSURE HYDRAULIC GENERATOR RECEIVER FOR POWER TRANSMISSION

[76] Inventor: Jean Malfit, Le Napoleon - 2 Avenue de Chapotte, Tournon, Ardeche, France

[21] Appl. No.: 803,102

[22] Filed: Nov. 27, 1985

[51] Int. Cl.[4] ..... F03C 2/08; F04C 2/18; F04C 5/00; F04C 15/00

[52] U.S. Cl. ..... 418/72; 418/126; 418/129; 418/132; 418/152; 418/156; 418/189; 418/201

[58] Field of Search ..... 418/72, 77, 131, 152, 418/189, 201, 71, 74, 75, 132, 126, 129, 156

[56] References Cited

U.S. PATENT DOCUMENTS

| | | | |
|---|---|---|---|
| 557,123 | 3/1896 | Hall | 418/72 |
| 2,029,742 | 2/1936 | Sieverts | 418/72 |
| 2,188,702 | 1/1940 | Burghauser | 418/72 |
| 2,212,994 | 8/1940 | Vrolix | 418/74 |
| 2,338,065 | 12/1943 | Ungar | 418/74 |
| 2,491,365 | 12/1949 | Ernst | 418/72 |
| 2,541,010 | 2/1951 | Ungar | 418/74 |
| 2,837,031 | 6/1958 | Ilune | 418/129 |
| 3,291,061 | 12/1966 | Shinohara | 418/74 |
| 3,817,665 | 6/1974 | Myers | 418/189 |
| 3,986,800 | 10/1976 | Dworak et al. | 418/74 |

FOREIGN PATENT DOCUMENTS

| | | | |
|---|---|---|---|
| 515521 | 11/1920 | France | 418/77 |
| 795534 | 1/1936 | France | 418/72 |
| 57-20580 | 2/1982 | Japan | 418/156 |
| 57-76284 | 5/1982 | Japan | 418/129 |
| 769763 | 3/1957 | United Kingdom | 418/132 |

*Primary Examiner*—John J. Vrablik

*Attorney, Agent, or Firm*—Pollock, Vande Sande & Priddy

[57] ABSTRACT

Hydraulic gear-driven rotary machine (pump or motor) in which the gears are free-floating with no supporting shaft or bearings. Their internal ducts rotate, providing a commutation with the stator ducts. This maintains the hydraulic equilibrium of the gears. A hydrostatic compensating device on the faces of the gears and on their toothing assures internal tightness. The hydraulic gear-driven rotary machine is suitable for operation at very high pressure with hydraulic equilibrium and internal tightness.

15 Claims, 13 Drawing Sheets

26
39
3
36
43
24
37
6
34
26
29
23
26
3
35
23
24
30
23
30
6
33
23
26
29
42
29
41
21
41
28
19
9-10
19
28
19
28
28
28
19
41
22
41
29
29
29
42
28
28
28
23
35
3
30
23
24
30
23
33
6
23
26

FIG 12
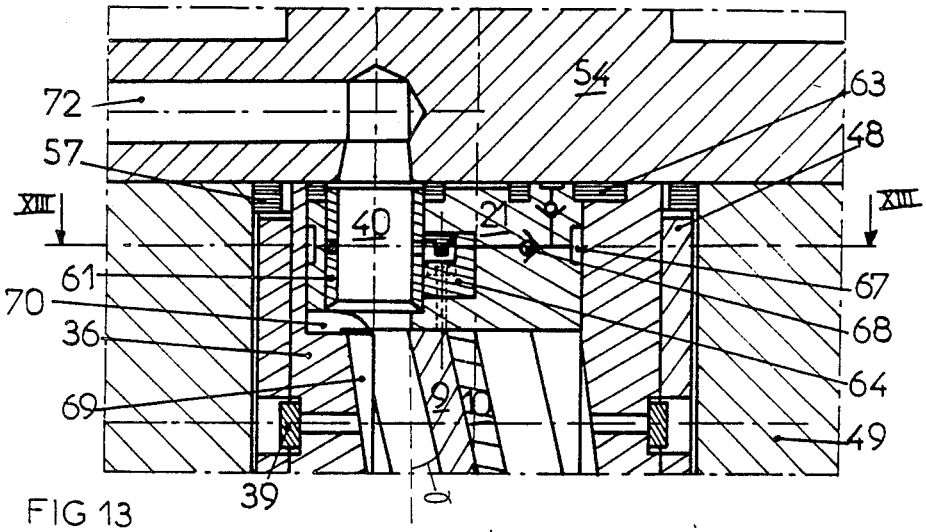
FIG 13
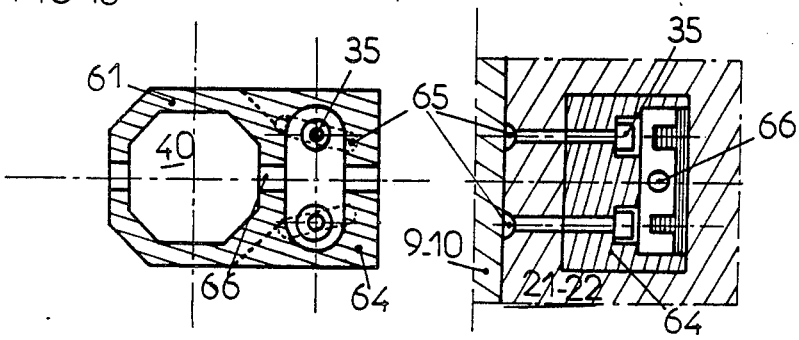
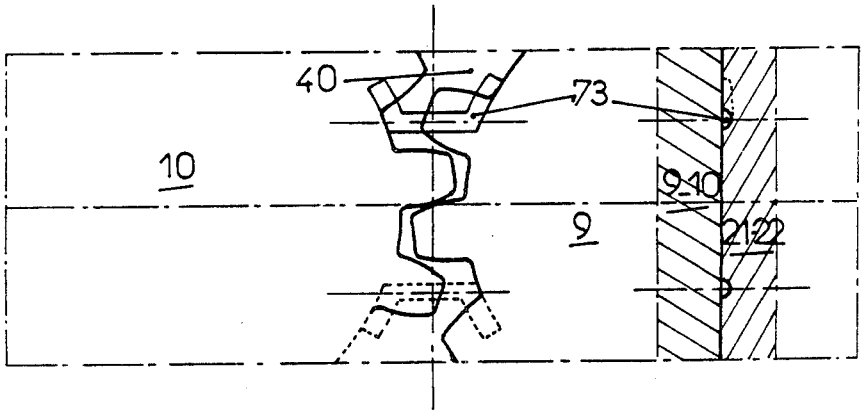
FIG 14

HIGH PRESSURE HYDRAULIC GENERATOR RECEIVER FOR POWER TRANSMISSION

BACKGROUND OF THE INVENTION

The subject of the present invention is a high pressure hydraulic generator receiver whose functions may be the following:

use as a hydraulic generator, hydraulic pump operating clockwise and counterclockwise;

or use as a hydraulic receiver, hydraulic motor operating clockwise and counterclockwise.

The design symmetry of this unit and its internal equilibrium make possible these multiple functions and its complete reversibility.

This high pressure hydraulic generator receiver will find its application in all the problems of transmission and reception of power and, in particular, in motor vehicle transmissions.

SUMMARY OF THE INVENTION

In accord with one embodiment of the invention, it is an object to to provide a reversible generator receiver for generating torque from fluid pressure or receiving torque to generate fluid pressure.

In accord another embodiment of the invention, it is a further object to provide a gear-type reversible generator receiver having balancing pressure on diametrically opposed regions of the respective gears to thereby provide integral bearings for the gears.

In accord with a further embodiment of the invention, it is an object to provide a helical gear-type reversible generator-receiver having axial thrust balanced by hydraulic pressure on end-faces of each gear.

BRIEF DESCRIPTION OF THE DRAWINGS

FIG. 12 is a partial cross-sectional view taken along line XII—XII in FIG. 3 through the axis of the generator receiver.

FIG. 13 is a cross-sectional view taken along line XIII—XIII in FIG. 12 showing associated tooth spaces.

FIG. 14 is an elevational view of another manner in which oil recovery can be attained from associated tooth spaces via a system of cells on the faces of associated plates.

DETAILED DESCRIPTION OF THE PREFERRED EMBODIMENT

Figure 1:
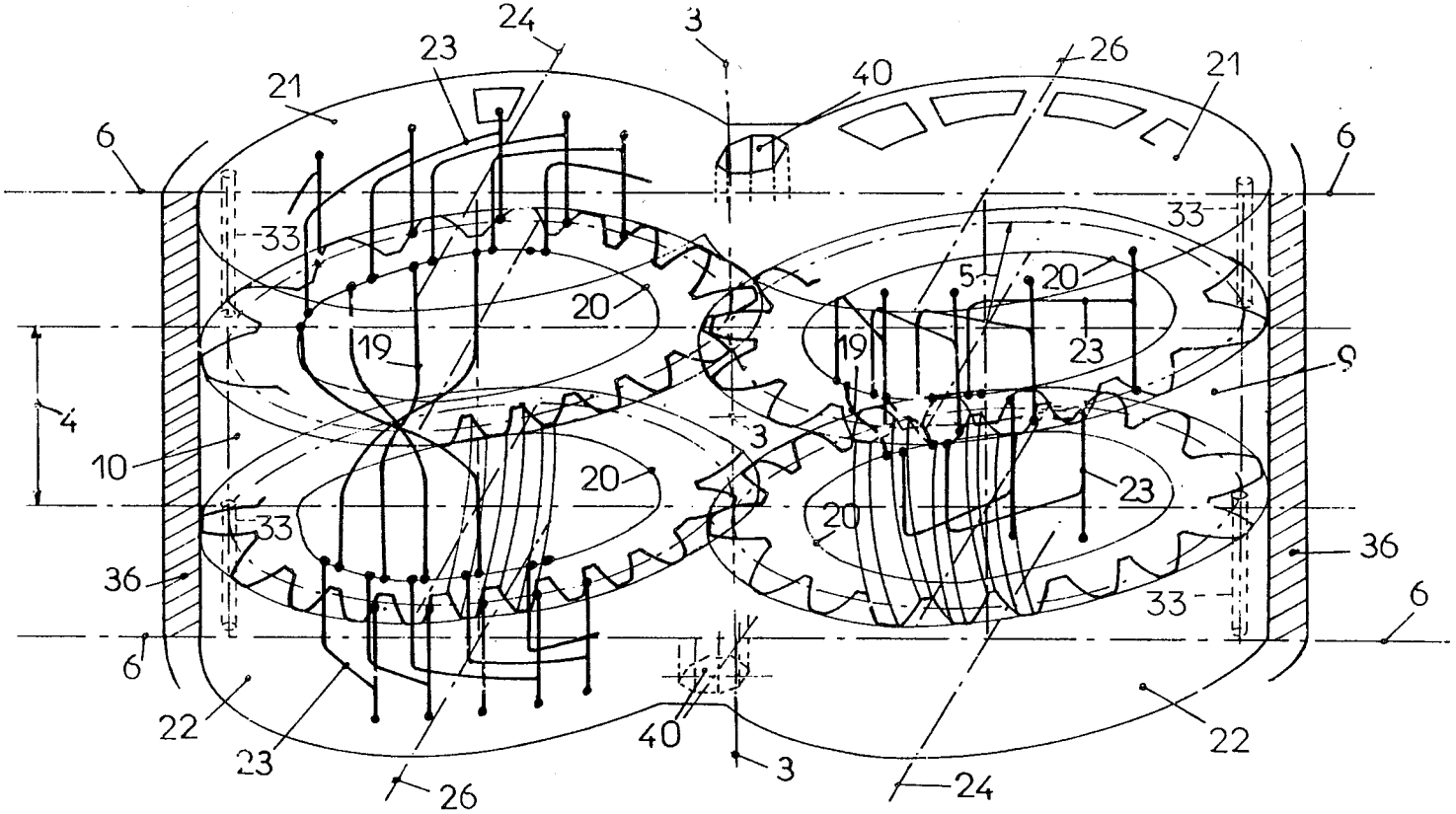
FIG. 1 is an elevational view shown in partial cross-section of a diagrammatic representation of associated free-floating gears of the present invention.

Since the functions of this unit are multiple and its reversibility is total, we shall call:

Low pressure 1: admission pressure (utilization as a generator), or back pressure (utilization as a receiver). This pressure shall preferably be greater than the atmospheric pressure (pressure reservoir).

High pressure 2: discharge pressure (utilization as a generator), or admission pressure, (utilization as a receiver).

Due to the symmetry of design and operation , the LP and HP indications may be HP and LP, and vice versa.

The indications furnished are given for one direction of operation and one HP-LP arrangement corresponding to this operation. Due to the total symmetry, the different operations will be deduced from the first one by symmetry.

This hydraulic generator-receiver design consists of the hydraulic and mechanical equilibrium of all the mechanical and pressure forces brought into play by generation or reception operation. It comprises a generator receiver of the type having helical gears installed in a casing surrounding the gears flangemounted with Delrin or nylon, thermoplastic polymer or thermoplastic composite flanges. The helix angle has a value resulting in an offset of a half step in the tooth profile between the two faces of the gears, an arrangement permitting a symmetrical design and a tightness in meshing at point 3.

If H is the width 4 of the gear, M the diametral pitch, $\alpha$ the helix angle at the pitch line, then $$tg\alpha = 2\ H/\pi M,$$

with M = apparent diametral pitch.

Under these conditions the delivery of the generator receiver will always be constant and no longer pulsating as in generator receivers with spur toothing or piston-driven generator generators.

The toothing adopted will be a low toothing where tooth space [gash]=0.95 M, and addendum=0.75 M which results in an effective tooth height of 1.50 M. There is constant meshing continuity due to the profile offset of a half step between the two faces of the gear; this provides a constant delivery, each tooth of each gear successively assuming the position of each tooth of the other gear, and vice versa. The difference alone between the tooth space of the theoretical tooth and the tooth space of the practical tooth at the point of meshing may result in a very slight irregularity in delivery.

There is identical pressure in the diametrically opposed tooth spaces for the same angular position except at mesh point 3 and at the opposite points 6, HP-LP transition zones: tooth space to tooth space equilibrium. The objective of this arrangement is the total equilibrium of each gear as far as the pressure forces at work on the toothing are concerned, each tooth space having the same pressure as the opposite tooth space for the same angular position of $\pi$ radians, except at mesh points 3 and 6 opposite 3 on each gear.

There is equilibrium, by means of "hydraulic bearings," of the radial forces at mesh point 3, forces resulting from the transmission of generating or receiving torques and the pressures in 3. These "hydraulic bearings" are obtained by creating an equilibrium pressure at points 6 on each of the gears.

Due to this complete equilibrium, the gears pivot in the casting and roll one on the other at point 3. Conventional tooth bearings and bush bearings become useless, are eliminated and replaced by "hydraulic bearings."

The two fundamental points of this design, the equilibrium of the pressure forces and the creation of "hydraulic bearings," are connected, the method of implementation of the first conditioning the implementation of the second.

Figure 15:
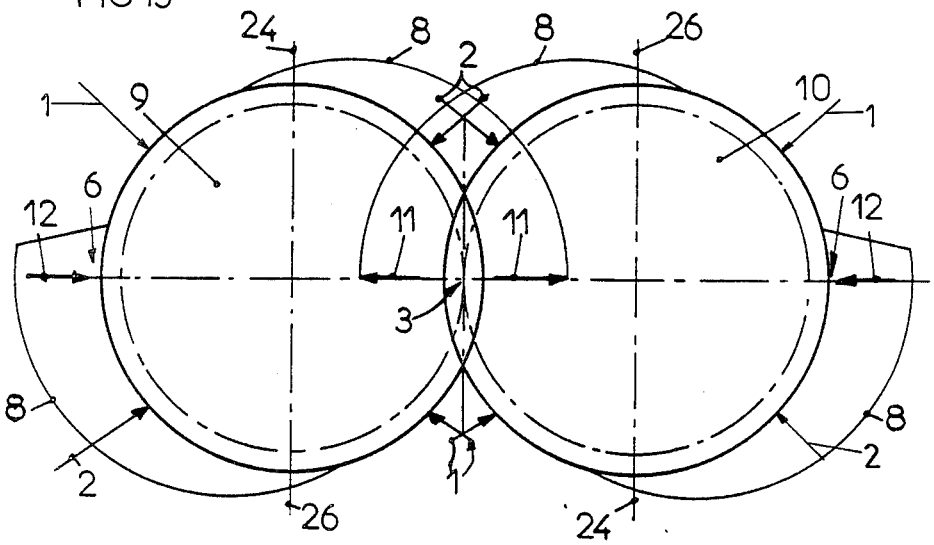
FIG. 15 is a diagrammatic representation of the pressure curves therearound free-floating gears in the radial direction.
Figure 16:
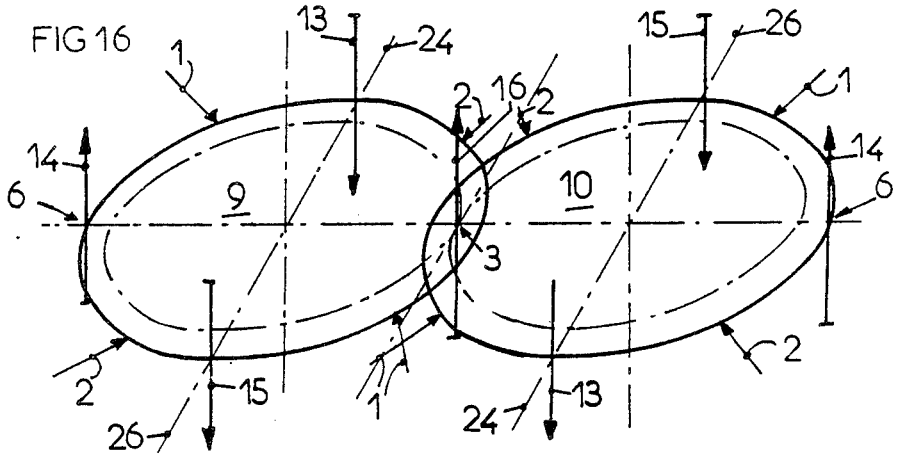
FIG. 16 is a diagrammatic representation of the axial pressure forces acting upon the free floating gears.

The total equilibrium of the gears is shown in FIGS. 15 and 16.

In FIG. 15, curve 8 shows the distribution of the high and low pressures around each of the gears 9 and 10.

R is the radial component 11 of the pressure forces and mechanical forces acting on the gear at point 3.

PRY is the resultant force 12 of the pressure forces acting at points 6 and creating the "hydraulic bearings."

The forces 2 are in equilibrium.

The forces 1 are in equilibrium.

The forces 12 balance the radial components 11 in 3.

The tangential forces are balanced by the forces providing the generating or receiving torque.

FIG. 16 shows the equilibrium of the axial forces created, pressure forces and mechanical forces at mesh point 3 and pressure forces at points 6 on the one hand, and pressure forces on the rest of the toothing, on the other hand.

13, 14, 15 and 16 are the axial components of the hydraulic pressure forces on the toothing of the gears, originating from the pressure which exists between the gear teeth. Components 14 and 16 are the axial resultants, with respect to each gear, of the pressure forces due to the pressure gradient engendered by the hydraulic fluid on the side of the tooth separating the high pressure and low pressure zones, which side is subjected to the high pressure. Components 14 and 16 are applied in one direction, components 13 and 15 in the other direction so that equilibrium between them is established.

Achieving equilibrium must be considered from two aspects:

A theoretical aspect which assumes no internal leaks and totally non-compressible oil. Based on this assumption, the balancing of the toothing, tooth space by tooth space, by an internal circuit connecting the diametrically opposed tooth spaces will be instantaneous since it is achieved without delivery and without oil compression. This will be achieved with gears having an even number of teeth Z.

A practical aspect which will consider internal leaks as inevitable and oil as having a certain value of compressibility given by its coefficient of compressibility $\beta$. Balancing tooth space by tooth space will not be instantaneous and, to obtain the same pressure value at two opposite points, the internal equilibrium circuit will connect the diametrically opposed tooth spaces, but with a supplementary half-step offset. This will be achieved with gears having an even number of teeth Z.

Considering pressure and speed variations, this arrangement will never be satisfactory for achieving perfect equilibrium, but the general concept will be handled in such a way that the resultant of the forces drives the gears toward the high pressure orifice.

Figure 6:
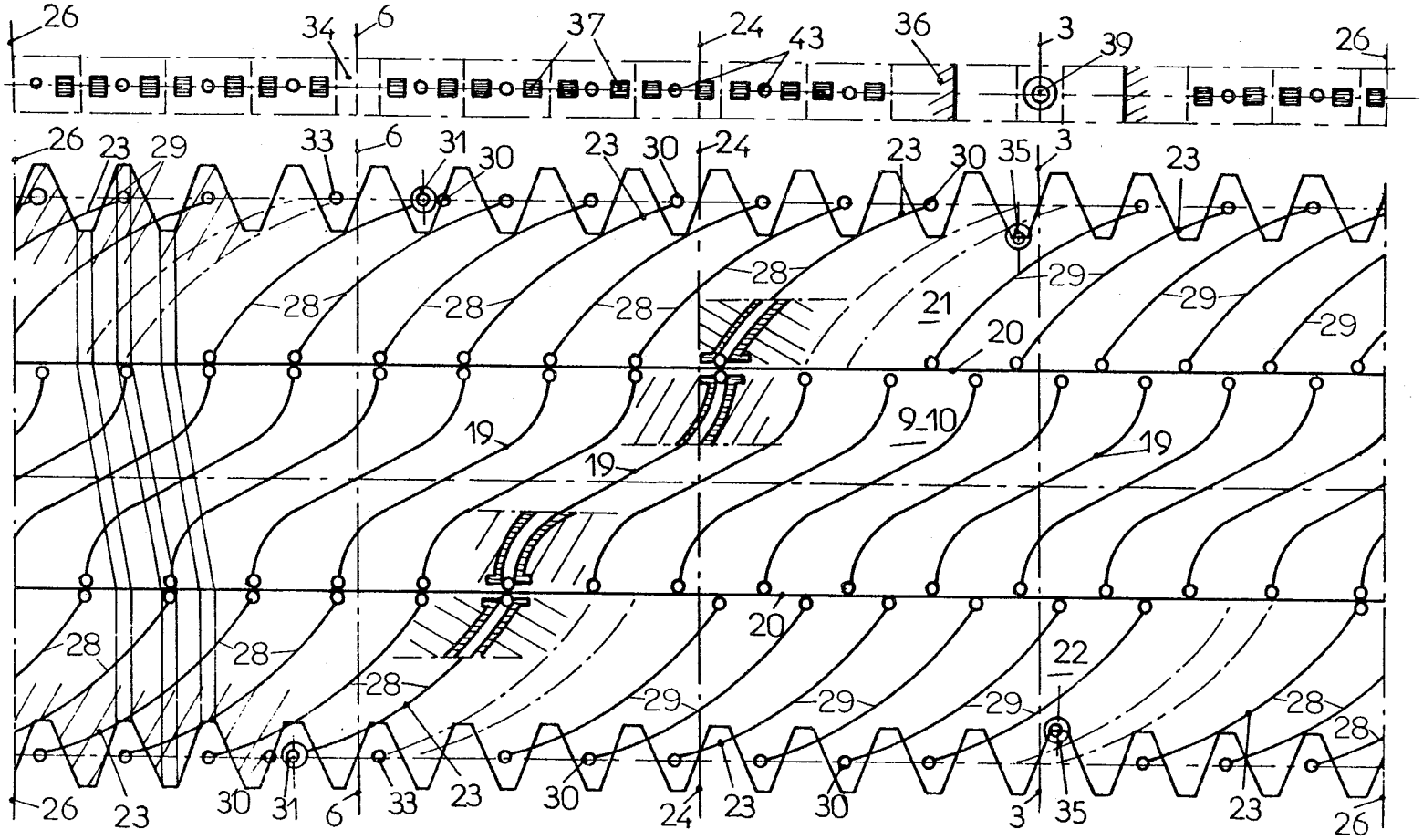

The theoretical aspect of this equilibrium is shown in FIG. 6, a model representation of the equilibrium of a gear with Z even or, in this example, sixteen teeth. The middle strip represents an enlarged cross section of a gear 9 or 10 showing a succession of conduits 19 overlapping one another, separated by a distance corresponding to one angular step, starting at one of the faces of the gear and ending at the other face, the start and stop being located on a circle of equal diameter called the circle of commutation 20. The small circles at the end of the conduits schematically represent the intersection of the conduit with circle 20.

On both sides of this middle strip, there is a repetition respectively of the upper face and the lower face of the gear showing the profile of the toothing of each of the faces and their position relative to each other, that is, with an offset of a half step, the hatch marks indicating the full position of the tooth. Each of these repetitions corresponds to the rubbing surface of the upper plate 21, on one side, and, on the other side, of the lower plate 22 on the upper and lower faces of the gear. It is these plates 21 and 22 which receive the conduits 23, separated from each other by a distance corresponding to one angular step, which start at a theoretical point on the pitch diameter of the gear and end at the circle of commutation 20, the circle where the conduits 19, located inside the gear and shown in the middle strip, end.

The conduits 23 situated in the plates 21 and 22 are stationary and constitute the stator of the "hydraulic winding." The conduits 19 rotate with the gear 9 or 10, are mobile and constitute the rotor of the "hydraulic winding."

Figure 11:
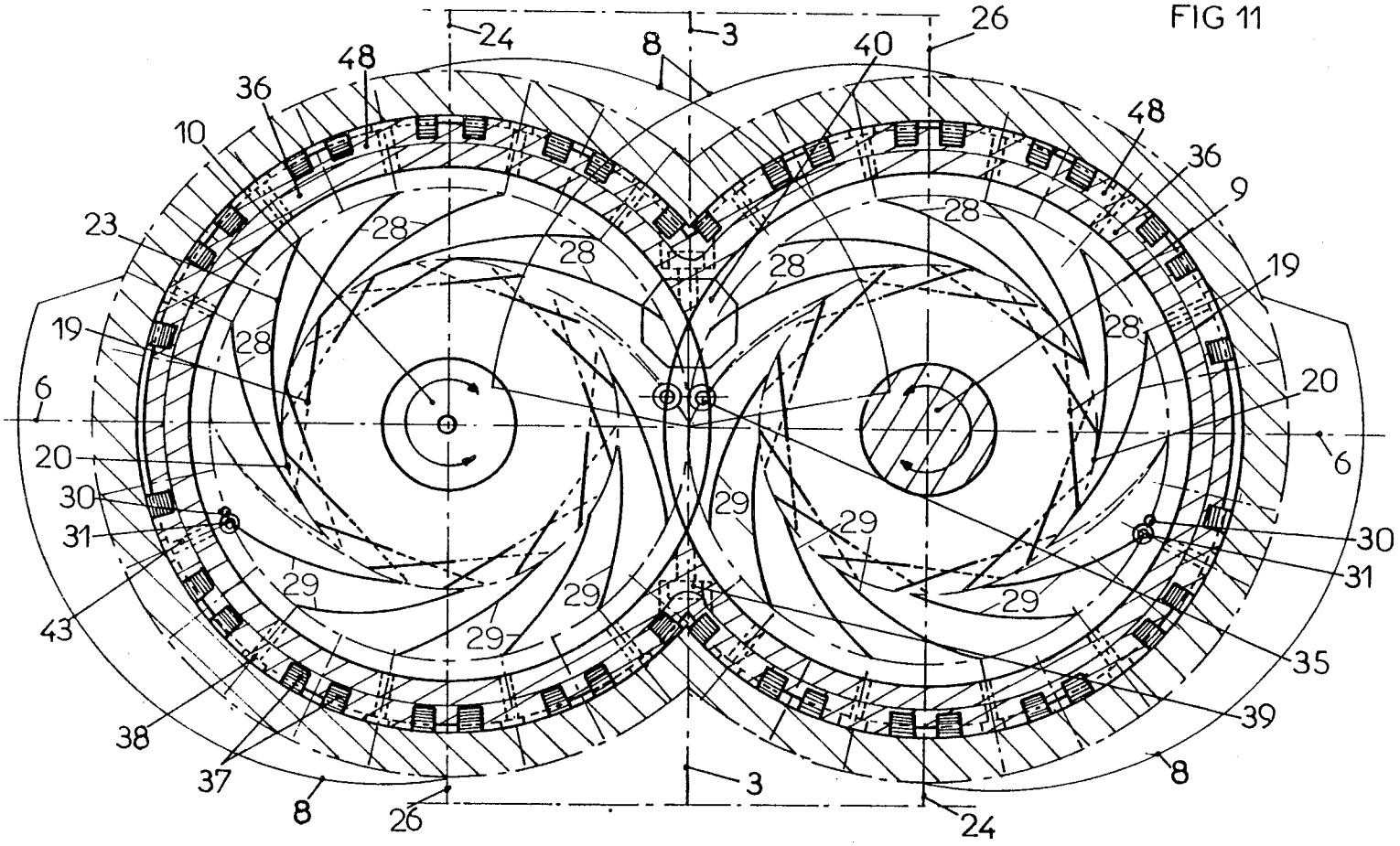
FIG. 11 is a cross-sectional view taking along line XI—XI in FIG. 2 showing the front view of the free-floating gears with the associated plates and further illustrating the conduits which make up to stator and rotor "hydraulic windings".

The commutation, that is, the connection between the conduits 23 and 19, occurs on the circle of commutation 20, shown in FIG. 11 (Section XI-XI).

The axes 24, 6, 26 and 3 mark off the four 90° sections of this design. Point 3 is the HP lift point on the top sector and the LP induction point is located on the bottom sector, always with the understanding that HP - LP⇄LP - HP, with possibility of two directions of rotation for the gears.

Pressure equilibrium is achieved by connecting the conduits 23 of plate 21 with the conduits 23 of plate 22 via the conduits 19 situated inside the gears. This connection between diametrically opposed tooth spaces occurs during the rotation of the gear and for a displacement corresponding to half an angular step, taking into account the theoretical position of the start of the conduits 23 on the pitch diameter of the toothing and the inside diameter of the conduits 23 and 19.

Two groups of conduits 23 must be considered:

the group of conduits 28 centered in sector 3, 24, 6 going to the rolling circle of sector 3, 24, 6 of top plate 21 and centered in sector 3, 26, 6 to the rolling circle of sector 3, 26, 6 of bottom plate 22.

the group of conduits 29 centered in sector 3, 26, 6 going to the rolling circle of sector 3, 26, 6 of top plate 21 and centered in sector 3, 24, 6 to the rolling circle of sector 3, 24, 6 bottom plate 22.

These two groups of conduits 28 and 29 are symmetrical in relation to the axes 6 and 3, and are offset in relation to each other by a half step, this offset being effected at points 3 and 6, and will consequently be stressed successively by the conduits 19 of the rotor— each group respectively over a distance corresponding to half an angular step $\pi M/2$: group 28 open, group 29 closed and vice versa. These two groups of conduits 28 and 29 bring together the same tooth spaces if we take the conduits having the same angular position to the rolling circle and, because of this fact, assure continual contact between the diametrically opposed tooth spaces due to the conduits 19 of the rotor. This value of continuity will be a function of the value given to the overlap of the respective actions of the conduits of groups 28 and 29, in ratio to the diameter of the conduits, the value of the angular pitch on circle 20, the radial position of the end of the conduits 23 in reference to the pitch diameter of the gear, the theoretical angular distances between conduits being equal to $\pi M$ in the interior of groups 28 and 29 and in the gears.

Each group 28 and 29 will act over a distance slightly greater than one angular step, or $\pi M+\delta$, with $\delta$ representing the overlap.

The equilibrium circuit between two opposite tooth spaces covers an angle corresponding to $(Z-1)/2 \cdot \pi M$, whether the group of conduits is 28 or 29, there is perfect design symmetry. Effecting complete equilibrium from diametrically opposed tooth space to tooth space is thus assured.

Figure 21:
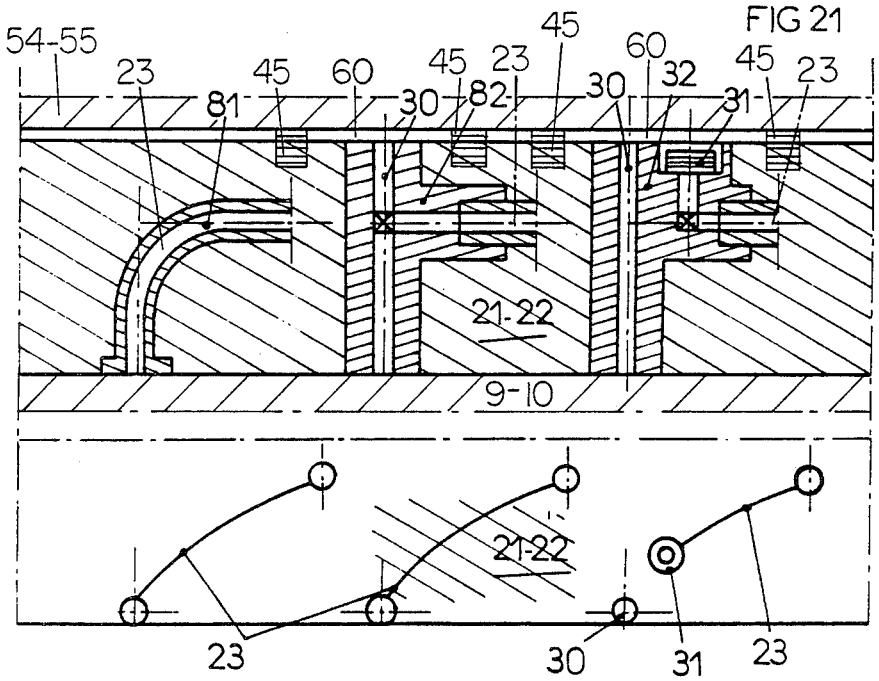
FIG. 21 is a cross-sectional view of associated conduits in free-floating gears as well as schematic representations thereof.

The creation of the "hydraulic bearings" will be achieved in the following steps elimination of the conduits of equilibrium derived from points situated on both sides of 3 and at one-fourth the pitch of the axis or $\pi M/4$. These conduits are represented by the fine dot-and-dash lines in 3 and 6.

installation on the conduits 23 ending closest to the axis 6 of a non-return valve 31 connected to a connecting conduit 30 of equilibrium sector 60 on the plate with the corresponding tooth space. FIG. 21, assembly 31, connecting conduit shape 32, the assembly permitting the connection in the direction of 3→6, and not the reverse (non-return function), to prevent the premature decompression of the "hydraulic bearing" in 6.

supply by a conduit 33 in each plate 21 and 22, same role, leading from zone 34, zone of maximum total permanent pressure at the corresponding tooth space located in 6 assuring the HP supply of this tooth space and thus the creation of the "hydraulic bearing" balancing in 6 the forces located in 3.

the assembly is supplemented by a non-return valve 35 at point 3 whose role is the evacuation toward 2 of the oil from the tooth spaces at the end of meshing and whose function will be clear upon examination of FIG. 12, Section XII, XII meshing conditions.

This theoretical aspect of gear equilibrium is supplemented by the representation of the equilibrium of the casing 36 surrounding gears 9 and 10 by sectors of hydrostatic equilibrium on the strip located on the top part of the enlarged representation, showing the casing 36, the seals 37, the equilibrium orifices 43, the non-return valve 39 at point 3 for supplying zone 34 as well as the two ends of casing 36 in 3.

The assembly thus constructed is totally symmetrical in reference to a central point located at 3 at half the height of the gears 9 and 10 on the pitch diameter. The equilibrium is theoretically perfect if there are no internal leaks and if the hydraulic oil is absolutely non-compressible.

Since internal leaks exist and the hydraulic oil has a certain value of compressibility $\beta$, the transmission of pressure will not be instantaneous and will result in a pressure unbalance toward the orifice side 40. Operation will be possible, will poorly absorb the blows of the hydraulic ram, whence another practical design permitting the priority supply of the tooth spaces located in the sectors opposite the orifice 40: connection of the tooth spaces with a certain offset by giving the priority of a pressure in advance to the tooth spaces opposite the orifice 40.

If Z is even, this offset will be equal to one tooth, or 360°/Z, and will result in an unbalanced mechanical design, symmetry having been practically eliminated.

If Z is odd, this offset will be equal to half a tooth, or 360°/2Z, and will result in a balanced design sufficient to absorb the delay in pressurization due to internal leaks and the compressibility of the oil.

Figure 7:
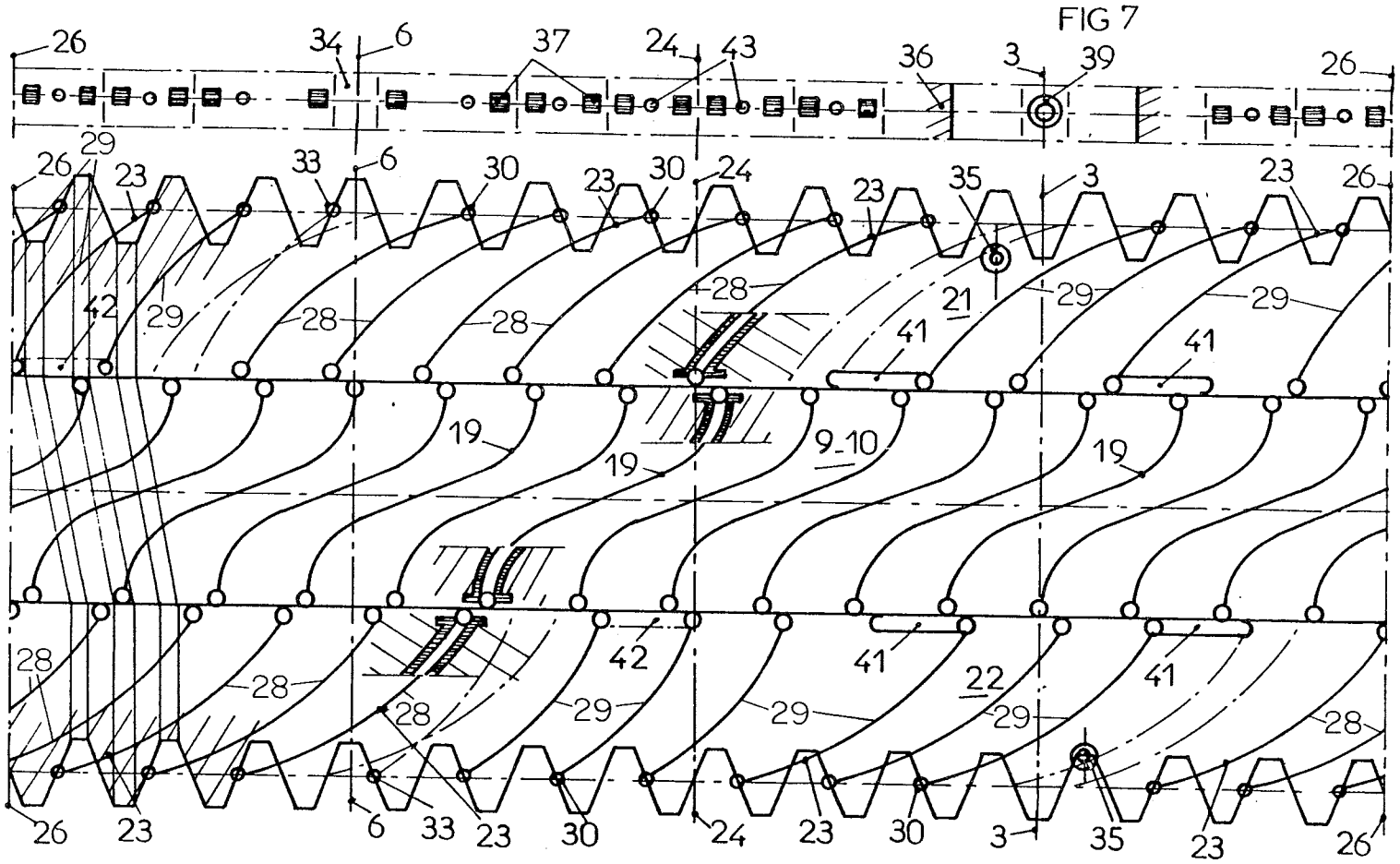
FIGS. 6 through 9 are diagrammatic representations of different "hydraulic windings" for equilibrium.

The practical aspect of this equilibrium has two versions:

The version in FIG. 7, an enlarged diagram of the equilibrium of a gear with Z being odd in the example of Z=15 teeth, and an equilibrium step, distance between two conduits equal to $\pi M$ angular, that is, at the angular pitch to the rolling circle.

Figure 8:
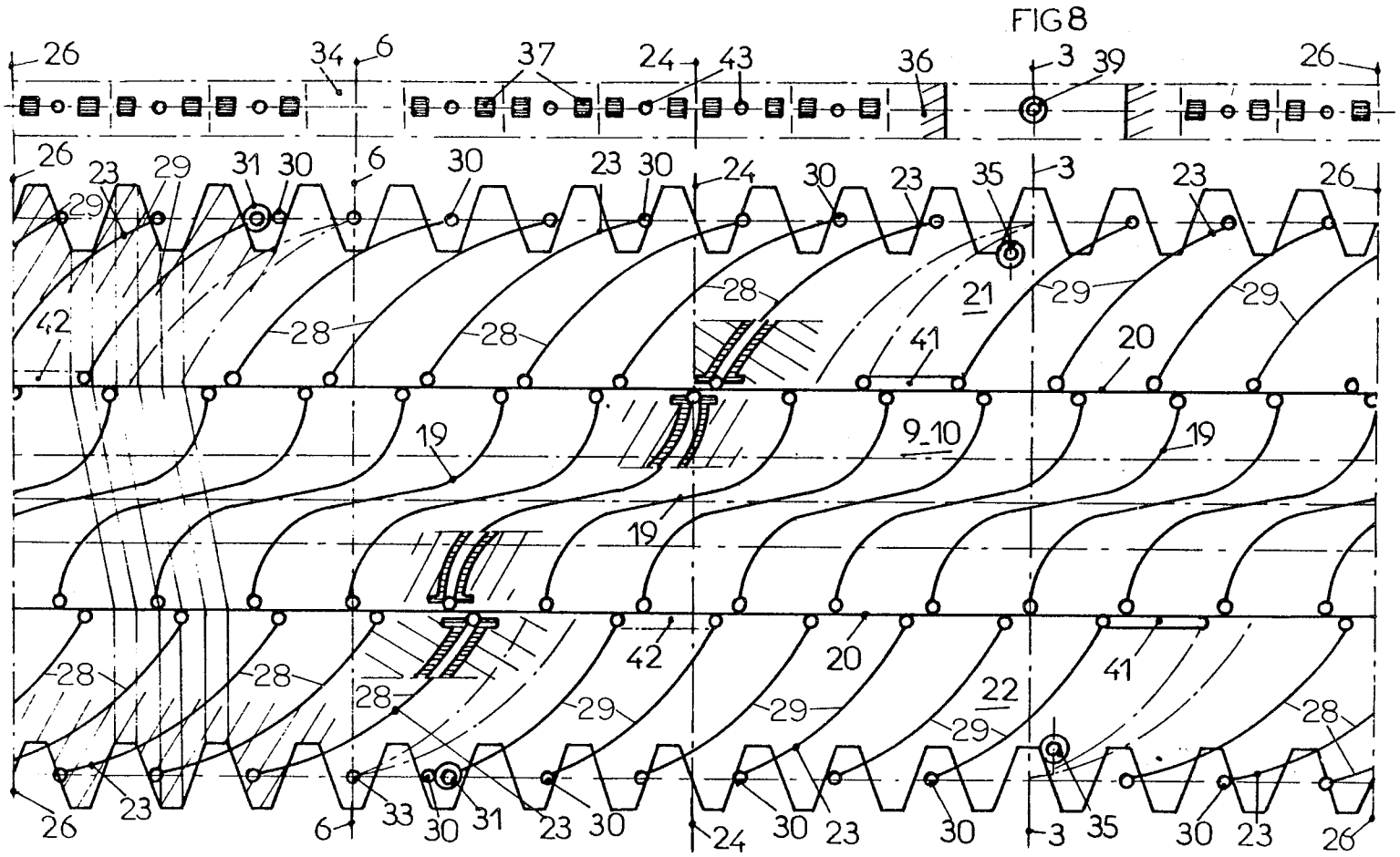

The version in FIG. 8, an enlarged diagram of the equilibrium of a gear with Z being odd in the example of Z=15 teeth, and an equilibrium step, distance between two conduits equal to $(\pi M\ Z)/Z\text{-}1$.

This equilibrium permits equal distribution of the conduits with perfect symmetry.

Version of FIG. 7: the equilibrium step$=\pi M$ angular. Identical role to that examined in FIG. 6 for the conduits 23 in the plates 21 and 22.

Two groups of conduits 23:

the group of conduits 28, going to the rolling circle of sector 3, 24, 6 of the top plate 21 and going to the rolling circle of sector 3, 26, 6 of the bottom plate 22. In this group the equilibrium connection covers an angle corresponding to Z/2 steps or 180° which permits a connection at 180° plus a half step in the direction 3, 24, 6.

the group of conduits 29, going to the rolling circle of sector 3, 26, 6 of the top plate 21 and going to the rolling circle of sector 3, 24, 6 of the bottom plate 22: in the group, the equilibrium connection covers an angle corresponding to Z/2 minus one step, or 180° minus a half step in the direction 3, 26, 6.

Group 28: angle 180° plus a half step in the direction 3, 24, 6.

Group 29: angle 180° minus a half step in the direction 3, 26, 6 which corresponds to the same position of the tooth spaces linked in group 28 and in group 29.

Since the number of teeth Z is odd, there is a full tooth opposite a tooth space and the connection is made between the tooth space above and the angularly lagging tooth space in reference to the first one in the sector opposite the HP-LP orifice. It all occurs as if the sector opposite the orifice 2 were priority supplied with a value corresponding to half step to compensate for the fact that its supply takes place through conduits with a delay due to the compressibility of the oil and possibly to internal leaks.

If $\beta$ is the coefficient of compressibility of the oil, $V2/V1=-\beta\ (p2\text{-}p1)$ will permit tying volumes V2 and V1 to pressures p2 and p1 and calculating the volumes of oil to have pass through the equilibrium conduit as well as the conduit diameter necessary to obtain a flow time less than the time of rotation of the gear corresponding to half an angular step. This flow time will be less than the time of rotation of a half step for the highest speed of rotation such that the resultant of the pressure forces is always in favor of the sector opposite the sector containing orifice 2, or, in our example, resultant of sector 3, 26, 6 greater than the resultant of sector 3, 24, 6.

The gears are then pushed toward orifice 2 by this resultant of the pressure forces whose magnitude will be greater as the speed is less. Equilibrium will thus be created by acting on the maximum speed of rotation, the viscosity of the oil, the diameter and length of the conduits, the maximum operating pressure and the volumes of the tooth spaces. The internal leaks also intervene to the extent that in a system in equilibrium with gears pushed toward orifice 2, they contribute to reinforcing this equilibrium by permitting it to be reached more quickly and must limit their action to assure the most rapid compression of the oil; the output losses will then be limited to the losses due to the compressibility of the oil.

The compressibility of the oil as well as its molecular flow behavior, leaks for clearances on the order of a micron, will be studied in particular.

The creation of this practical "hydraulic winding" for an odd number of teeth Z and an equilibrium step equal to $\pi$M means that the conduits 23 of group 29 do not cover the same connection angle as the conduits 23 of group 28. For this reason, the connection is not the same as at group 28 where there is complete symmetry between the conduits 23 of plates 21 and 22.

Conduits 23:

Group 28 two and a half steps (plate 21)$\leqq$two steps and a half (plate 22).

Group 29 two and a half steps (plate 21)—one and a half steps plate 22 or one and a half steps (plate 21)—two steps and a half (plate 22).

To retain the complete symmetry of design between plates 21 and 22, the groove 41 on the circle of commutation 20 will make it possible to have complete symmetry of the conduits 23 of group 29 in plates 21 and 22.

An identical groove 41 on the circle of commutation is also used to join the first two conduits of group 29 exiting at points 6 and 3, this groove 41 in this case being replaceable by groove 42. These grooves 41 and 42 are on the circle of commutation 20 and have a cross section identical to the cross section of the conduits 23 or 19.

The "hydraulic bearings" at 6 will be based on the same principle as the design Z even but with some modifications:

elimination of the non-return valves and conduits 31 at 6, which become useless, with modification of the dimension of the sectors of hydrostatic equilibrium in 6.

for the rest, the same conditions as for Z even with supply of the "hydraulic bearing" via conduit 33 and non-return valves 35 in 3.

same conditions also on the representation of hydrostatic equilibrium of casing 36 with seals 37, the supply holes 43, the non-return valves 39 at point 3 for supplying zone 34.

The assembly is like the one in the design of FIG. 6, perfectly symmetrical in relation to a central point located at 3, halfway up the gears 9 and 10, on the pitch diameter.

Version of FIG. 8: equilibrium step$=(\pi M\ Z)/Z-1$, or $(\pi M\times 15)/14$ for Z odd$=15$ teeth.

This version permits an even more balanced and much simpler design and a better equilibrium of the assembly.

It is a matter of selecting an equilibrium step, that is, a distance between conduits as close as possible to the value of the step $\pi$M and permitting an equal division of the circumference by an even number, such as to be able to place a conduit starting at the rolling circle at point 6 and a conduit starting at the rolling circle at point 3 in each of the plates 21 and 22. This value of the equilibrium step is therefore necessarily equal to $(\pi M\ Z)/Z\text{-}1$, that is, the value of the circumference at the rolling circle divided by the number of teeth minus one.

We then have the design of FIG. 8 with the distance between conduits 23 on the one hand, and between conduits 19 on the other, equal to the equilibrium step, and where the non-return valves 31 and the conduits 30 reappear.

Conduits 23 group 28: the connection covers two and one-quarter equilibrium steps.

Conduits 23 group 29: the connection covers one and three-quarter equilibrium steps.

A connection circuit of group 28 affects the same tooth spaces as the corresponding connection circuit of group 29.

Connection group 28: 180° angle+a half step in direction 3, 24, 6.

Connection group 29: 180° angle−a half step in direction 3, 26, 6.

One step offset, or two times one-half step given by the difference of the angle covered by the conduits 23 between the groups 28 and 29; the connections affect the same tooth spaces.

The conduit 23 at 3 is replaced by the connection 41 (or 42 in fine dot-and-dash lines), groove on the circle of commutation 20, connected to the following conduit since at the same pressure potential.

The conduit 23 at 6 is replaced by the conduit 33 which makes the creation of "hydraulic bearings" possible by supplying the latter with high pressure from zone 34, zone of maximum permanent total pressure (everywhere or there is no equilibrium sector).

Again at 3 we find the same non-return valve 35 for evacuation toward the orifice 2 of the tooth spaces and the same equilibrium conditions on the casing 36 with the seals 37, the holes 43, the non-return valve 39 of the supply of zone 34.

The same equilibrium conditions as for the version in FIG. 7 are created, but simplified and of a more symmetrical design. The commutation between the conduits 23 and 19 on the circle 20 take place successively, lines of conduits 23–19, after lines of conduits 23–19 with a time lag corresponding to the time necessary for the gear to turn the difference between the equilibrium step and the step of the rolling circle, or $\pi M$ $Z/Z-1-\pi M=\pi M/Z-1$, that is, the rolling circle step divided by the number of teeth minus one. The commutations are therefore not simultaneous by group 28 or 29 as in the versions of FIG. 6 or FIG. 7.

This simplest, best balanced version of FIG. 8 is the version adopted for the following development of this study and for an odd number of teeth Z equal to 15 teeth. The versions of FIG. 6 and FIG. 7 are variations which are less simple, less well balanced, less attractive, but possible and acceptable.

In the enlarged equilibrium diagrams for the gears in FIG. 6, FIG. 7 and FIG. 8, the circle of commutation and the distances on that circle should be thought of as an angular value because, due to the way they are depicted, they seem to have the same length as the pitch circle, although it is markedly smaller. The overlaps between the conduits appear insufficient but should correspond to a half step on the rolling circle for the versions in FIG. 6 and FIG. 7, and a half step of equilibrium for the version in FIG. 8.

The conduits are theoretically centered on the rolling circle but may be offset outside or toward the inside in relation to the rolling circle for an increase or reduction of overlap.

The supply conduits 33 for the "hydraulic bearings" starting at zone 34 are theoretically centered on the pitch diameter but may be offset toward the outside or toward the inside, forward or back angularly in relation to point 6, according to the conditions of tightness or priority operation as a generator or receiver, to increase or reduce the action of the "hydraulic bearings." These conduits 33 may also be placed on the casing or may be eliminated if the conditions of tightness in 6 are perfect, the "hydraulic bearings" then being created and preserved by maintaining tooth space pressure because of the compressibility of the hydraulic oil.

Figure 9:
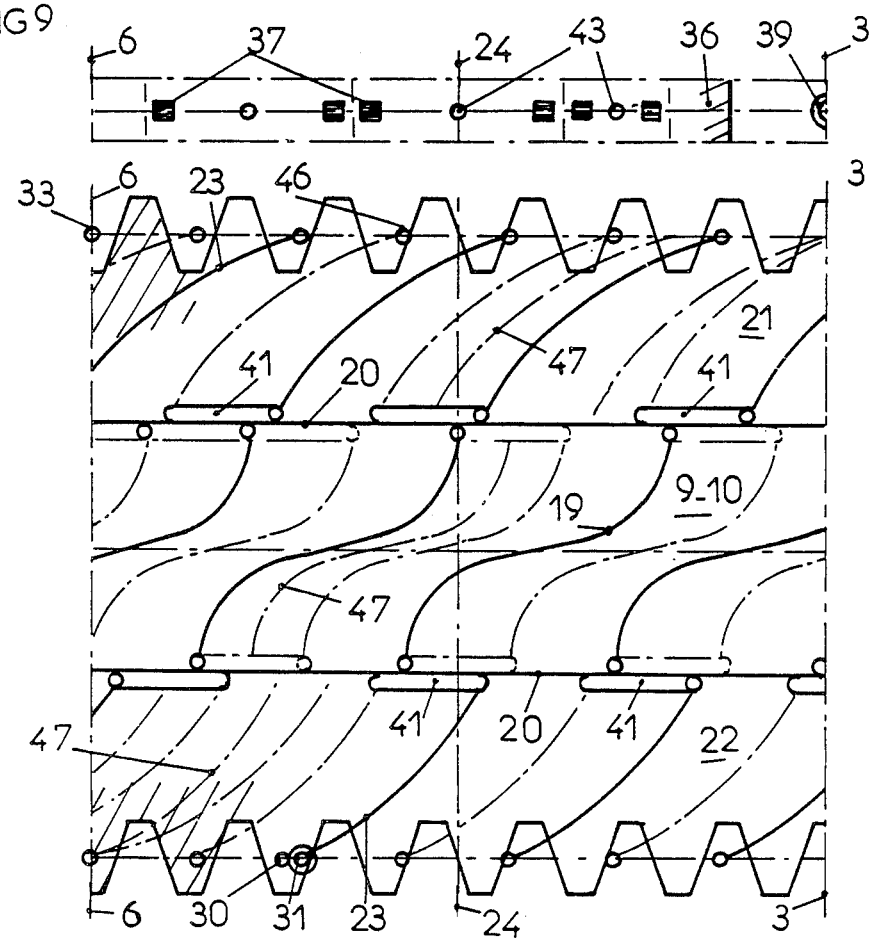

Another version of the Z odd solution with equilibrium step is shown by the enlarged diagram in FIG. 9 and permits equilibrium of the gears of units with low power and high speeds of rotation where the conditions of space and design do not permit easy arrangement of the equilibrium conduits. It is a matter of creating an equilibrium sector by sector, each sector comprising one (version in FIG. 8), two (version in FIG. 9), three or n teeth, these sectors being connected by a line of conduits 23–19 and corresponding to the sectors of hydrostatic compensation on plates, delimited by a seal 45, FIG. 10, Section IX - IX. These sectors are connected to the corresponding tooth spaces by conduits 46 positioned like the ends of the fictitious conduits 23. The equilibrium sectors may also be connected by a circuit 47, median line of the circuits rearranged in the connected sectors and connected to the tooth spaces by the conduits 46.

These collective conduits will be at a distance of $\pi M$ $Z/Z-1 \times n$ and will be terminated at the level of the circle of commutation 20 by grooves 41 corresponding to the connection of the rearranged conduits.

The example in FIG. 9 is a rearrangement of two teeth per sector for $Z=15$ teeth. The conditions at 3 and 6 are unchanged in relation to the version in FIG. 8. To permit the conduit rearrangements, $Z-1$ must be divisible by 2n if n is the number of rearranged conduits or some other number, if we assume various rearrangements in the same unit, for example of one, two, three . . . n teeth, but $Z-1$ must always be even and Z odd.

In summary, equilibrium can be obtained:
whatever the number of teeth, even or odd,
whatever the equilibrium step adopted,
whatever the rearrangements of the teeth,
with other helix angle values than $tg\pi=2\ H/\pi M$, for example $tg\alpha=3\ H/\pi M$ or $tg\pi=4\ H/\pi M$.

The conditions at 3 will be more difficult (flow, output regularity, bottom of teeth evacuation) and the symmetries of design, particularly for the plates, will no longer be observed, but the design is possible.

The most rational designs will be obtained on the basis of FIG. 8 and FIG. 9, with Z being odd and equilibrium step equal to $\pi M$ $Z/Z\text{-}1 \times n$ with n=one, two, three, etc., and $Z-1$ divisible by 2n, with $tg\alpha=2\ H/\pi M$ resulting in a constant output, the best conditions of equilibrium, the best performance at mesh point 3.

The design of this hydraulic generator receiver with helical gears must be oriented toward the largest possible number of teeth, the highest pressures compatible with the resistances of the external piping and the zero functional clearances, and will require for this reason a hydraulic oil with the lowest possible coefficient of compressibility and having good molecular flow properties to provide lubrication with zero clearances under HP, a hydraulic oil composed of short carbon chain hydrocarbons or mechanically sheared.

The first fill up with hydraulic oil will be under internal vacuum, and the first pressurization will be done without rotation via th orifices 40 in order to install the fundamental internal elements.

The output will be a function of the compressibility of the oil and the mechanical friction. The internal leaks will contribute to the progressive compression of the oil in proportion to the approach of orifice 2, and will no longer be involved in practice in the output losses (or to the decompression of the oil in the operation as a motor).

The principles of equilibrium of the gears and the creation of "hydraulic bearings" will be supported on the principal construction points of the generator receiver according to the design corresponding to the enlarged diagram in FIG. 8.

Figure 2:
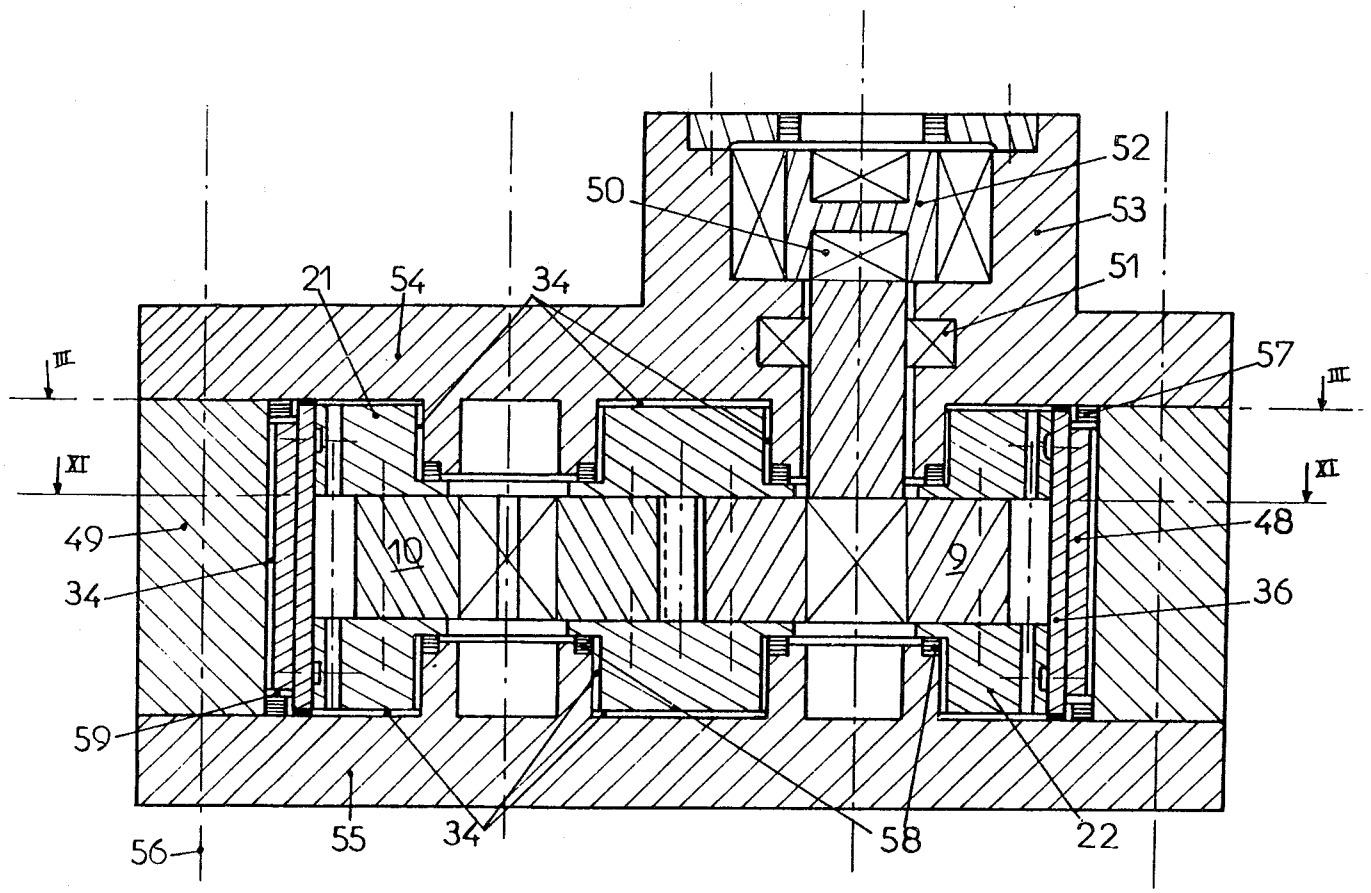
FIG. 2 is a cross-sectional view taken along line II—II of FIG. 3 showing the manner in which associated helical gears rotate in a flexible casing of the present invention.

FIG. 2, Section II—II: the helical gears 9 and 10 as defined above rotate in a flexible casing 36 which is very hard and/or possesses good friction properties, of nitrided steel or composite materials to which is bonded a lining 48 of nylon or Delrin type thermoplastic polymers or polyesters. The casing contains the seals of the hydrostatic equilibrium sectors on the outside diameter of the teeth of gears 9 and 10. This casing 36 encases the two gears, is adjusted internally to a diameter slightly larger by a few hundredths of a millimeter than the outside diameter of the gears, and the adjustment is done under tension, that is, the casing must close on the outside diameter of the gears 9 and 10 except at point 3 which, due to its rigidity, will retain the curve of adjustment to permit the entrance of the teeth when the gears are rotating. The seals of the hydrostatic equilibrium sectors on the casing may also be placed in the body 49; the lining 48 would then be dispensed with, but the casing 36 must then display a surface condition on the outside diameter, which is somewhat more difficult to obtain, the blank of the casing being obtained by extrusion for a casing 36 made of nitrided steel.

The gears 9 and 10 have no support surfaces for bearings, these being replaced by the casing 36 and the outside diameter of the gears, by the rotation of the gears 9 and 10 over each other at point 3 and by the "hydraulic bearings" at points 6. Gear 10 has a central orifice for evacuating leaks from HP to LP; its general schematic is not shown, but it is conventional for this type of equipment. Gear 9 has a shaft-mounted section beside the motion pickoff 50 for transmitting the generating or receiving torque. This shaft-mounted section may either be integral with the center section of gear 9 or connected to the latter by grooves because it is subjected only to torsional stresses. In this design the center sections of the gears 9 and 10 would then be identical, with a grooved steel core.

The shaft-mounted section of gear 9 receives the outside seal 51 and has, at its end, the grooves 50 inserted into the motion pickoff 52, mounted on a needle bushing. This motion pickoff 52 located in the center 53 of the generator receiver is intended, by its shape, to prevent external shocks on the gear 9 and any axial stress on the latter.

The gears 9 and 10 make up the rotor of the generator receiver and receive the conduits 19 as described above.

Figure 3:
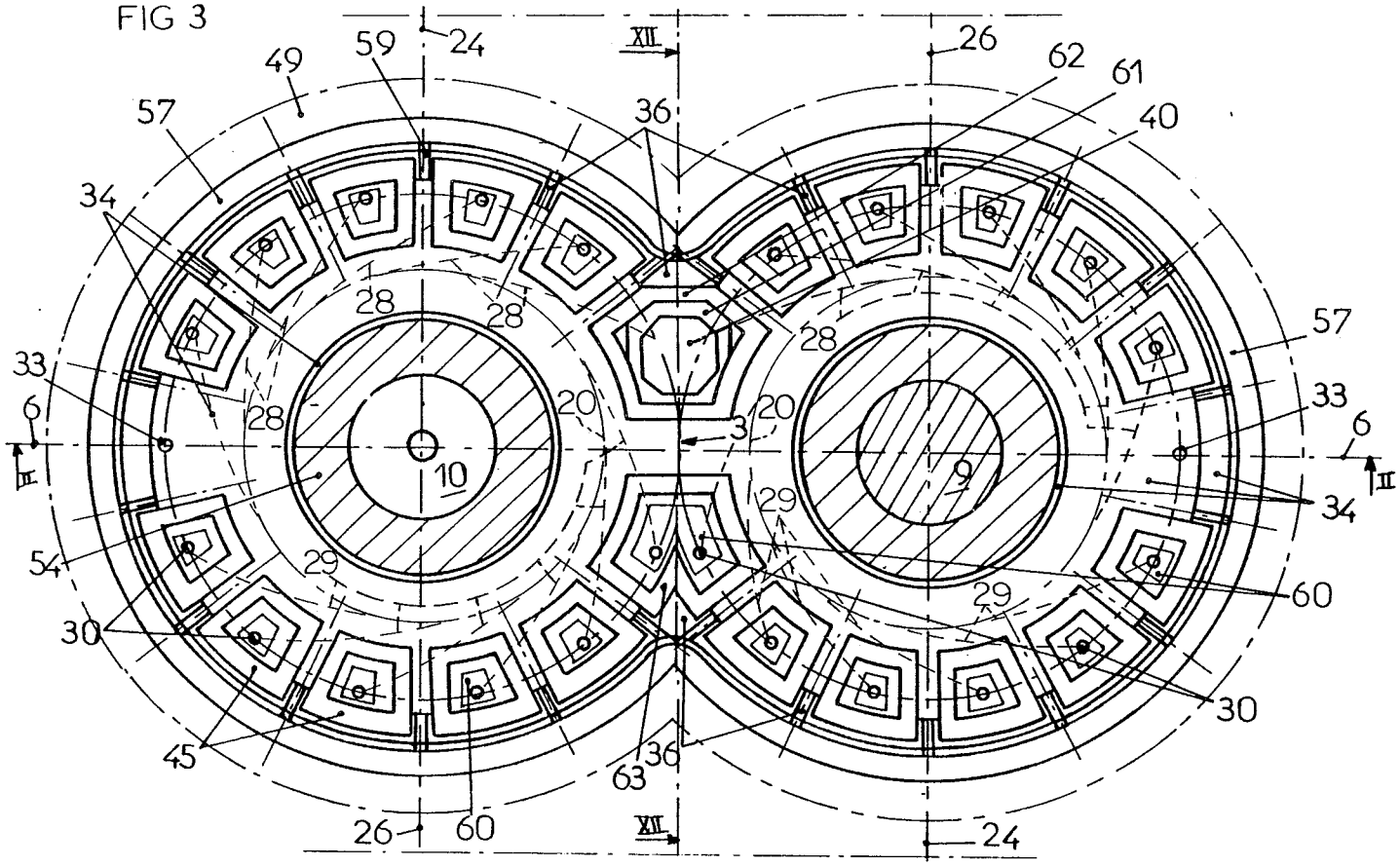
FIG. 3 is a partial cross-sectional view taken along line III—III in FIG. 2 illustrating a top plate or a bottom plate wherein seals are located for delimiting sectors of hydrostatic compensation of the present invention.

Tightness on the faces of the gears 9 and 10 is assured by the plates 21 and 22 which form the stator of the generator receiver. These plates are of thermoplastic polymers or polyesters of the nylon or Delrin composite type, that is, having powdered metallic fillers to improve the thermal conductivity properties. They are in one piece on each face for the gears 9 and 10, are molded with inserts formed by the conduits 23, non-return valves 35, conduits 33 (FIG. 8) and supply orifices and HP - LP delivery orifices (FIG. 3, Section III—III). The outside diameter will be greater by a few hundredths of a millimeter than the outside diameter of the gears to permit the casing 36 to compress the outside of the plates 21 and 22 to the outside diameter of the gears 9 and 10, and thereby to ensure the tight seal between casing 36 and plates 21 and 22.

The assembly of the gears 9 and 10 and plates 21 and 22 is located in the body 49, made of light metal alloy or cast iron, on which the covers 54 and 55, also of light metal alloy or cast iron, close; the entire unit is put together with bolts 56.

The cover 54 has on the center 53 the generator receiver securing clamp (not shown).

External tightness is assured by the seals 57 between body and covers, 58 between plates and covers 51 on the shaft-mounted section of gear 9.

The clearances 34 shown in this FIG. 2, Section II—II, between the body 49 and the casing 36, 48, and between plates 21 and 22 and covers 54 and 55, form the area at permanent total maximum pressure generated or received by the generator receiver. The conduits 59 provide the connections between the various sections of this zone 34 whose pressurization will be facilitated by recesses maintained by grid-type metal inserts (not shown) particularly in the annular zone between plates and covers.

FIG. 3, Section III—III, shows the top plate 21 or the bottom plate 24 in which are located the seals 45 which delimit the sectors of hydrostatic compensation created by the recesses 60 in which the supply conduits 30, pressure pickoffs on the conduits 23, as well as the supply conduits 33 of the "hydraulic bearings" at points 6 starting from zone 34 and shown on the pitch diameter of the gears end. Each supply conduit 30 is a pressure pickoff on the conduit 23 in order to constitute a connection between the tooth recess and the recess 60 so as to place the latter under the same pressure.

The orifice 40 is created by the insert 61 and the seal 62 and, opposite this orifice, the sector of hydrostatic compensation delimited by the seal 63.

On the periphery of plate 21 or 22, FIG. 3 shows the position of the casing 36 around the gears 9 and 10, the seal 57 between body and cover, the orifices 59 connecting the zones 34.

Figure 4:
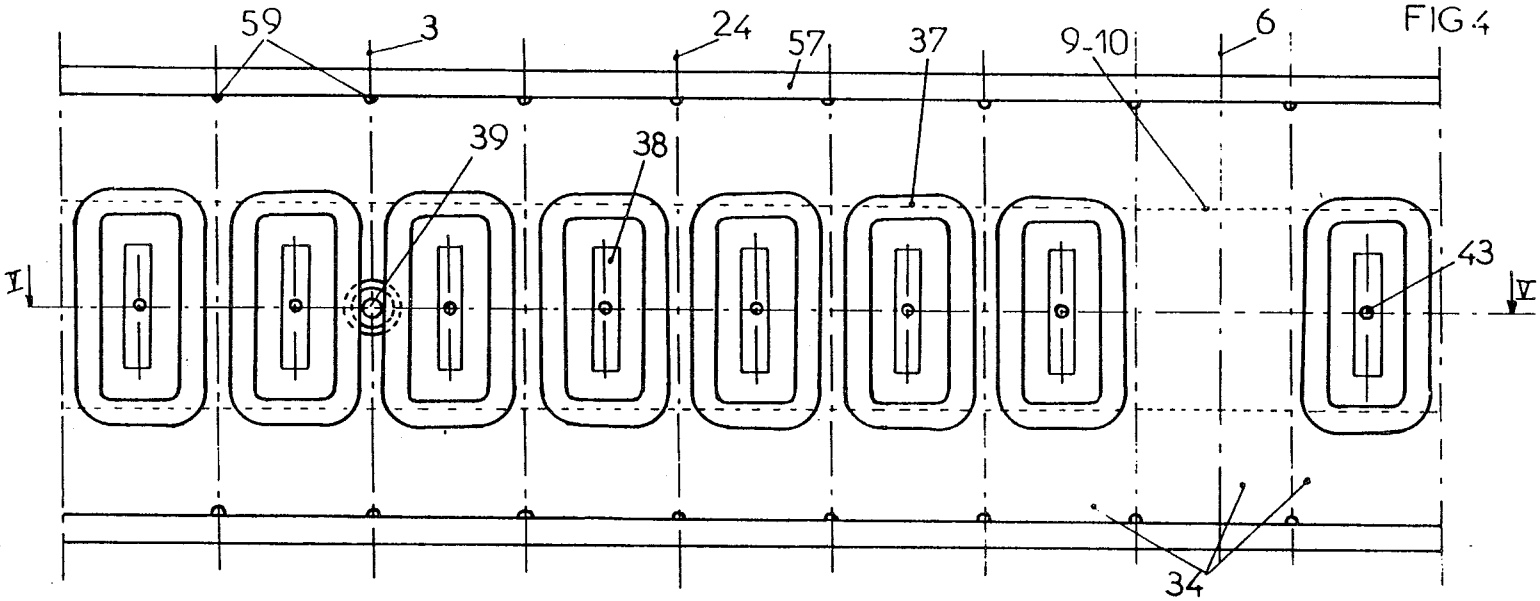
FIG. 4 is an elevational view of outside the casing showing the position of the free-floating gears and sectors of hydrostatic equilibrium of the present invention.

FIG. 4 is an enlarged view of the outside of the casing 36, 48 showing the position of the gears 9 and 10 and the sectors of hydrostatic equilibrium delimited by points 37, created by the recesses 38 and supplied by the orifices 43 whose diameter will be as small as possible and less than the width of the tip of the gear tooth to prevent leaks from one tooth to the next during commutation on these orifices. It should be noted that this commutation takes place from tooth pair to tooth pair with a time delay corresponding to the rotation of the gear of $\pi M/Z$-1.

The non-return valves 39 at point 3 permits the supply of zone 34 at the maximum pressure of generation or reception.

The sectors of hydrostatic compensation have been shown parallel to the axis of the gears which does not correspond exactly to the tooth spaces to be balanced, but this is not serious due to zone 34 located in relation to the plates 21 and 22 which is clearly overabundant. The only objective of this hydrostatic compensation on the toothing is to attenuate the action of zone 34 which will act in any event to hold down the casing 36 on the tip of the tooth. These sectors of hydrostatic compensation may be built with an incline corresponding to the incline of the helices of gears 9 and 10; the design will be a little less simple and the hydrostatic compensation better and more rational.

Figure 5:
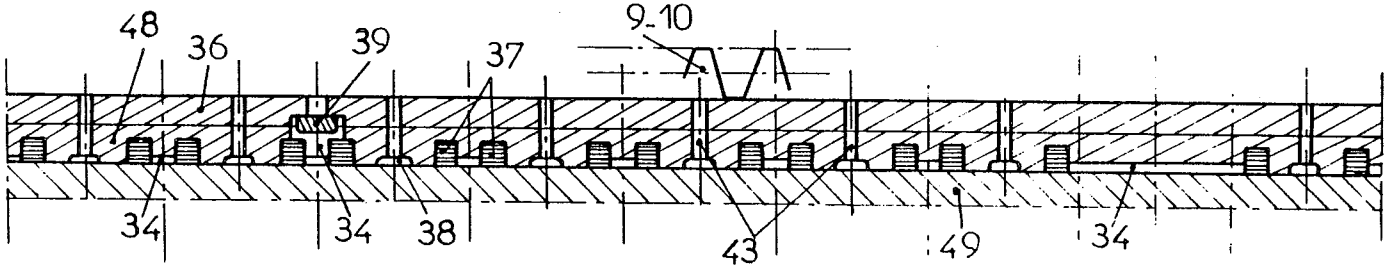
FIG. 5 is a cross-sectional view taken along line V—V in FIG. 4 showing the median section of the casing with the free-floating gears therein.

FIG. 5, Section V—V, shows a median section of the casing 36, 48 with gears 9 and 10, the body 49, seals 37, orifices 43, the recesses 38, zone 34.

FIGS. 6 to 9 are the enlarged diagrams of different "hydraulic windings" for equilibrium of gears 9 and 10.

Figure 10:
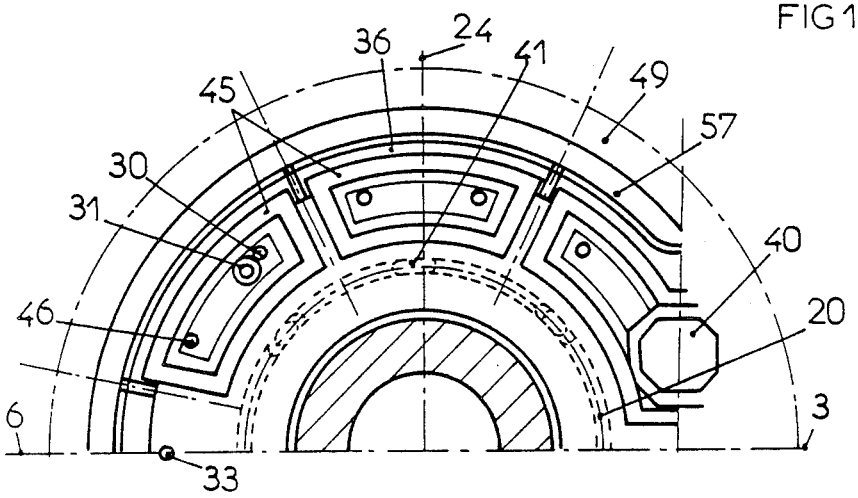
FIG. 10 is a partial cross-sectional view taken along line III—III in FIG. 2 embodying the "hydraulic windings" situation illustrated in the FIG. 9 grouping of conduits in the case of units with low power and high speeds of rotation.

FIG. 10, Section III—III shows the plates 21 or 22 in the situation of the enlarged diagram of FIG. 9—grouping of conduits in the case of units with low power and high speeds of rotation. The seals 45 delimit the equilibrium sectors corresponding to two teeth, are supplied by the conduits 30, pressure pickoffs on the conduits 23 and supply of the second tooth of the sector by conduit 46 via the zone of hydrostatic compensation.

This figure shows the circle of commutation 20 on which the cells 41 are located, enabling the connections replacing the eliminated conduits.

FIG. 11, Section XI—XI is a front view between gears 9 and 10 and plates 21 and 22 providing a panoramic view of the conduits making up the stator and rotor "hydraulic windings."

Conduits 23 of the top plate 21 which should not appear due to the section and conduits 19 of gears 9 and 10, the solid part of the conduit going from the top face of the gear and the dotted part ending at the lower face. The conduits 23 of the bottom plate 22 are not shown in order not to overload the figure, but may be deduced by central symmetry.

The conduits 23 start at one face of the plates 21 or 22 at the rolling circle of gears 9 and 10 and end at the same face of plates 21 and 22 at the circle of commutation 20, and the conduits 19 start from the circle 20 of one face of the gears and end at the circle 20 of the other face of gears 9 and 10, the rotation of the gears creating the connection or the breaking of the circuits by means of commutation at the rolling circle by the faces of the teeth and on the circle of commutation 20 by the end point orifices of conduits 23 and 19. The connections are made during a course slightly greater than a half equilibrium step.

This section shows the position of the casing 36, 48, the orifice 40, the non-return valves 35 for evacuating the teeth at point 3, the non-return valves 39, the seals 37, conduits 43 and recesses 38 of hydrostatic equilibrium on the casing.

The curves 8 represent the distribution of the pressure forces resulting from the equilibrium around the pinions 9 and 10, these curves progressing around an average value during rotation and being made up of a series of pressure stages corresponding to the tooth spaces.

FIG. 12, Section XII—XII is a half section through the axis of the generator receiver at point 3. The supply or return orifice 40 is created by the insert 61 located in the plate 21. This insert has a chamber 64 in which the two non-return valves 35 are located, the chamber being closed by a cover for isolating the non-return valves during molding. The non-return valves 35 open on the one hand into the orifice 40 via a conduit 66 and on the other into the cells 65 for recovery of the oil from the tooth spaces (FIG. 13, Section XIII—XIII) and depressed section. Non-return valves 35 have the function of preventing excessive pressure in the tooth spaces at the moment when these are cut off from orifice 40 during rotation, before the successive tooth spaces pass into low pressure. Valves 35 open in the direction of orifice 40 under high pressure only of the pressure in the said tooth spaces becomes greater than the high pressure. They operate only for the direction of rotation which corresponds to generator (pump) operation. Thus, for a given orifice, they open only in one direction of rotation. This chamber is also connected by a conduit equipped with a non-return valve 68, also located in the plate 21 or 22, to recover leaks or to create a partial vacuum in a groove or channel 67 around the plates 21 or 22 to assure perfect contact between the plates 21 and 22 and the casing 36.

The casing 36 has a recess 69 at the helix angle at the ends in 3 and opening into recess 70 located beneath orifice 40 and permitting good hydraulic fluid flow.

In this zone the plates 21 and 22 overlap the milled recesses of the casing 36.

The conduit 72 connects the orifice 40 to the external connection of the generator receiver.

FIG. 14 shows another version of oil recovery from the tooth spaces other than by the non-return valves 35 via a system of cells 73 on the faces of the plates 21 and 22, the tooth spaces being successively isolated from the orifice 40 when they go into low pressure by the closure of connection 73—tooth spaces→ orifices 40 by the face of the tooth of gear 9 or gear 10. The cell 73 plays the same role as the recess ports on spur gear pumps.

FIG. 15 gives an idea of the pressure curves 8 all around gears 9 and 10 in the radial direction.

The pressure forces 12 balance the forces 11 in 3 resulting from the pressures in 3 and the radial components due to the generating or receiving torque.

The HP and LP forces come into equilibrium advantageously for the HP forces oppposite orifice 2 due to the equilibrium offset of sector 6,26 in relation to sector 3,24.

FIG. 16 schematically shows the axial pressure forces acting on the gears 9 and 10.

The resultants of the pressure forces 13 and 15 balance the pressure forces 14 and 16. The "hydraulic bearings" at points 6 create at point 3 on each gear 9 and 10 a force of reaction which opposes the axial component on each gear 9 and 10 due to the generating or receiving torque.

Figure 17:
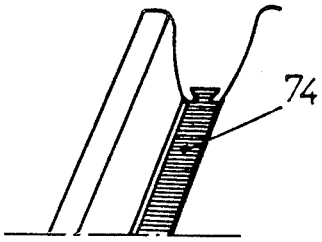
FIG. 17 is an elevational view of a tooth for a steel or metal gear.

FIG. 17 represents a tooth in the case of a steel or metal gear on which an anti-friction coating 74 is applied to the tip of the tooth, wear due to the friction occurring primarily on the tip of the teeth and secondarily on the casing 36, to assure a good seal. This coating 74 may be a metal deposit or a bonded plastic coating.

Figure 18:
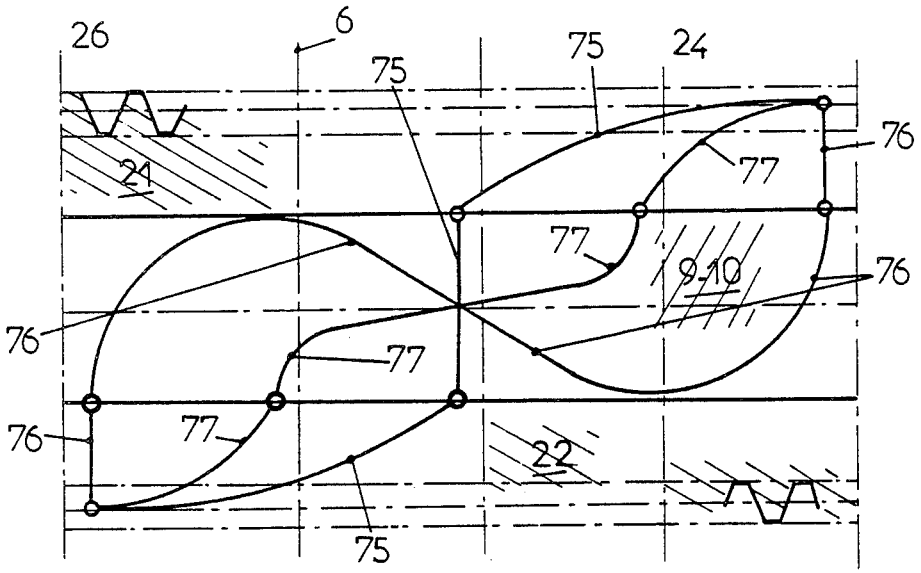
FIG. 18 is a diagrammatic representation for different solutions of circuits between two tooth spaces of the gears.

FIG. 18 shows different solutions of circuits between two tooth spaces of the gears by means of conduits 23 in the plates and 19 in the gears.

Circuit 75: the conduits 23 in the plates 21 and 22 cover an angle equal to half the total connection and conduit 19 in the gears 9 and 10 an angle of zero.

Circuit 76: the conduits 23 in the plates 21 and 22 cover an angle of zero and conduit 19 in the gears 9 or 10 covers an angle equal to the totality of the connection.

Circuit 77: this circuit represents all the intermediate solutions between circuits 75 and 76.

The choice will be made in relation to the width of the gears 9 and 10, a large width facilitating a conduit 19 biased between 76 and 77 and a small width a conduit biased between 75 and 76. The reverse for the conduits 23 in the plates, resulting in thicker plates 21 and 22 for narrower gears 9 and 10, the result of these considerations being the preservation of identical dimensions for the generator receiver for the same value of modulus M and number of teeth Z for different outputs, permitting the creation of a stepped range of equipment providing a regular progression of power.

Figure 19:
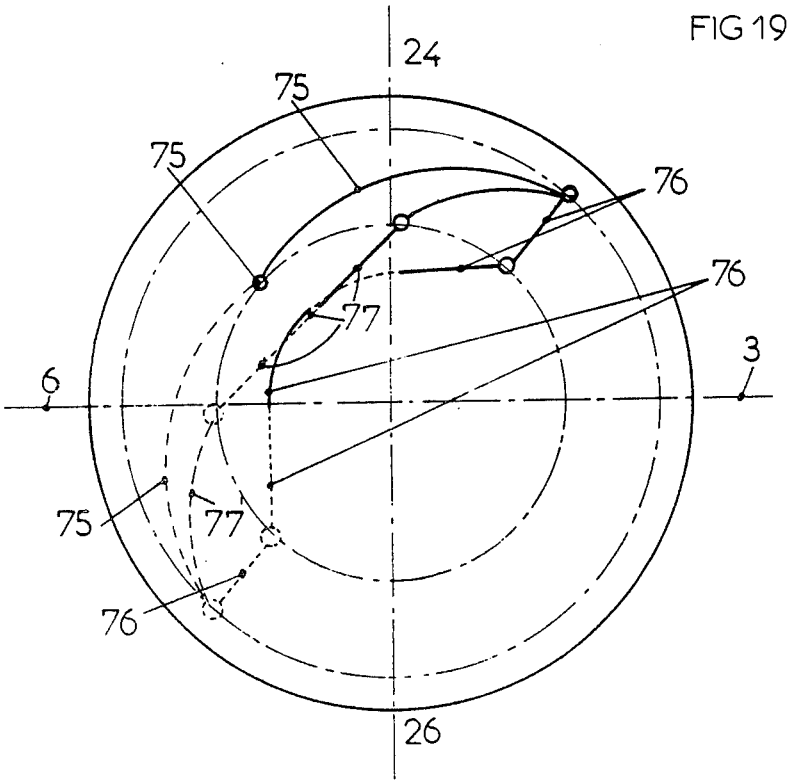
FIG. 19 is a diagrammatic representation showing different types of circuits with sections located in the top half shown with solid lines and the sections in the bottom half shown with dotted lines.

FIG. 19 gives a panoramic view of these different types of circuits 75, 76, 77 with the sections located in the top half shown in solid lines and the sections in the bottom half in dotted lines.

The type of circuit adopted will also have to take into account that in section 23 located in the plates 21 and 22, this section must adapt itself to the plasic deformation of the plates 21 and 22 to allow the casing 36 to make contact on the outside diameter of the gears 9 and 10. In particular, the shape of the circuit 76 and the adjacent shapes must be prohibited because they do not permit this deformation and also lead to dimensions for the conduits 19 in gears 9 and 10 which are too large.

Figure 20:
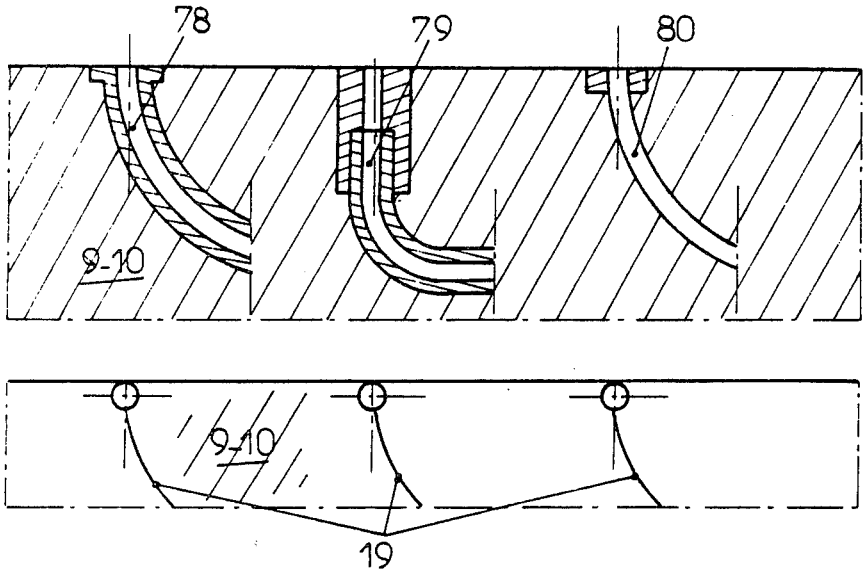
FIG. 20 is a cross-sectional view of associated conduits in free-floating gears as well as schematic representations thereof.

FIG. 20 shows various designs for conduits 19 in the gears 9 and 10 and their symbolic representation in FIGS. 6 to 9.

Conduit 78 may be a metal or plastic conduit, conduit 79 a metal or plastic conduit with a metal or plastic connector to position the conduit in the mold (mounting on point bars on the face of the mold).

Conduit 80 may be formed by a braced or sheathed flexible plastic cable in the case of gears 9 and 10 made of resin and fiberglass, carbon or metal based composite materials, and these cables are withdrawn after molding.

FIG. 21 shows various designs for conduits 23 in the plates 21 and 22 and their symbolic representation in FIGS. 6 to 9.

Conduit 81 without orifice 30 for equilibrium may be a metal or plastic conduit used in the case of low power units in which there will be no hydrostatic equilibrium, the dimensions not permitting it and the small tooth bearing not justifying it. The grouping of 2, 3, n teeth can still be accomplished by means of a groove on the face of the plate at the pitch diameter, without going through the non-existent sector of equilibrium.

Conduit 82 is a metal or plastic conduit in a metal or plastic connector containing the supply conduit 30 for the sector of hydrostatic equilibrium on the plate.

Conduit 32 is a metal or plastic conduit in a metal or plastic connector containing conduit 30 and a non-return valves 31, the system used in the version of FIG. 6 at point 6.

Conduit 23 may also be formed by a groove on the face of the plate 21 or 22, a groove running from the pressure pickoff point at the pitch circle to the point of connection with conduits 19 on the circle of commutation 20.

Conduit 23 may also be formed like conduit 80 of the gears 9 and 10, with a braced cable in a plastic coating and the cable removed after molding.

The practical implementation of specific fundamental elements of this helical gear-driven generator receiver will now be discussed The greatest difficulty lies mainly in the manufacture of the rotor and stator circuits.

The windings will be made outside and then installed in the molds.

For large units there are few problems because the dimensions permit easy placement of the conduits and the consideration of tapped conduits 19 in gears 9 and 10 made of steel according to standard manufacturing methods.

For small units, consider groupings of conduits and the possible elimination of sectors of hydrostatic equilibrium on the casing 36 and on the plates.

The entire design will be perfectly symmetrical in relation to the center point of the rolling circles at point 3 half way up the gears 9 and 10.

The gears 9 and 10 may be of steel with tapped conduits 19 for large units or, for small units, made in two sections, pressed on and soldered to the diameter of the circle of commutation 20, the conduits 19 made in halves, circular half section intersected by the circle of commutation 20, in each of the two sections, male and female, the copper soldering seam providing the assembly of the two sections between the conduits and assuring the relative tightness of the latter, the teeth cut before or after in relation to the conduits. The faces will be aligned and the gears mated within a thickness tolerance on the order of a hundredth of a millimeter.

The gears 9 and 10 may also be of composite materials with a steel hub with drive channels; they will be molded with the conduits 19 inserted in a duroplastic resin reinforced either with fiberglass, with carbon fibers or with metal powders permitting good thermal conductivity and assuring the dissipation of the heat of friction.

Since the lubrication of the contacts between plates and gears occurs under high pressure, the characteristics of friction in these conditions should be well studied.

The teeth may be cut or molded.

Plates 21 and 22 are molded with the metal inserts, conduits 23, inserts 61, metal inserts for conduits 33. These conduits 33 may rotate in the entire zone 6 according to primary use—generator or receiver—and according to the primary direction of rotation. The recess 67 may be machined. The powdered metal fillers enable the properties of thermal conductivity to be improved. Fillers of graphite or molybdenum disulfide improve the friction characteristics.

The seats of seals in the lining 48 of the casing 36 will be machined if necessary and will be perpendicular or inclined according to the incline of the helix angle of the gears 9 and 10.

The generator receiver according to the present invention is thus designed to operate with zero clearance at all the points where hydraulic leaks are likely. The design and definition of the sectors of hydrostatic equilibrium and of zones 34, the plasticity of the materials, particularly of the plates 21 and 22, and of the coefficients of friction must assure these zero clearances while not resulting in contact forces which are too great between the friction surfaces whose relative movements are assured by high pressure lubrication via the tooth spaces and at the points of commutation on the circle 20. The design will always be a compromise between the losses due to internal leaks and the losses due to friction with equilibrium between the losses and a well adapted hydraulic oil providing the maximum output of the generator receiver.

I claim:

1. A reversible generator-receiver for selectively generating torque from fluid pressure and receiving torque for generating fluid pressure, said generator-receiver comprising an assembly of:

(a) a plurality of free-floating interengaging helicoidal gear means, said gear means having teeth and two sides and being mounted without mechanical bearing means;

(b) a flexible casing having a generally 8-shaped cross section and surrounding said gear means;

(c) a plurality of side plates in abutment against the sides of said gear means;

(d) a rigid shell enclosing (a), (b) and (c);

(e) means for pressurizing the periphery of said flexible casing so as to force the latter against crests of said teeth so as to render spaces between said teeth fluid-tight; and (f) means for applying equilibrated pressure to said support members so as to obtain fluid-tightness on both sides of said gear means.

2. The hydraulic generator receiver according to claim 1, comprising an hydraulic winding comprising a plurality of rotor conduits in said free floating gear means and a plurality of stator conduits in said side plates, successive commutations between said plurality of rotor conduits and said stator conduits being provided by ends of said conduits passing one in front of the other along a circle of commutations and simultaneously on said tooth spaces at the level of a rolling pitch circle for another end of said stator conduits to provide permanent connection between said opposed tooth spaces for an even number of teeth and said opposed tooth spaces with an offset of a half step for an odd number of teeth diametrically opposite a mesh point of said free-floating gears, except in zones wherein hydraulic bearings are created.

3. The hydraulic generator receiver according to claim 2 wherein each zone of said hydraulic bearings opposite said mesh point is accompanied, on one hand, by a break in the connection between tooth spaces at one point and an opposite point and, on another hand, by conservation of pressure by supplying hydraulic bearings for creating with high pressure via a conduit member from a zone of permanent total pressure, said conduit member having a location to permit increasing as well as decreasing action of said hydraulic bearings according to the primary direction of rotation for the machine and according to whether the machine is designed for primary utilization as a generator or a receiver.

4. The hydraulic generator receiver according to claim 3, wherein each of said side plates is made of a flexible material selected from the group consisting of thermoplastic polymer and polyester said side plates being further reinforced with the group consisting of graphite or molybdenum disulfide to improve friction properties to allow each of said plates to yield in order to adapt to the outside diameter of said free floating gears under the effect of radial compression imposed by said flexible casing and by a zone of maximum total pressure.

5. The hydraulic generator receiver as in claim 4 wherein said free floating gears have at least one metal center core for absorbing the stresses of radial compression, said peripheral toothing and said rotor conduits are made out of the group consisting of metal and synthetic material reinforced with the group consisting of metal powders-graphite composite and molybdenum disulfide powders, said free floating gears are suitable for being tapped and made in at least two sections for being assembled by welding at the diameter of said circle of commutation, said conduits are made in halves in each of said two assembled male and female sections, said conduits further suitable for being inserted into said free-floating gears during molding.

6. The hydraulic generator receiver according to claim 5, wherein a first plate and a second plate have first and second sectors, respectively, delimited by first and second seals receiving opposing pressure via first and second conduits to create on said plates and on said flexible casing a hydrostatic equilibrium of particular interest for units with high power and high output.

7. The hydraulic generator receiving according to claim 6 wherein said flexible casing has non-return valve means located in said mesh zone of said free floating gears for supplying said zone of maximum permanent total pressure wherein the maximum pressure generated as well as received always prevails to permit the elimination of all mechanical backlash clearance.

8. The hydraulic generator receiver according to claim 6 wherein said seals of said sectors of hydrostatic equilibrium on said casing are installed in recesses made in a lining of a material the group consisting of said thermoplastic polymer and polyester bonded to said casing, said casing being aligned internally under stress to a diameter greater than at least one hundredths of a millimeter than the outside diameter of said free floating gears while said casing is finally offset on ends by a slope inclined at no more than a half step to a helix angle of said toothing.

9. The hydraulic generator receiver according to claim 8 wherein on faces of said first and second plates at the level of said circle commutation and said rolling pitch circle of said free floating gears are grooves to group at least two of said equilibrium conduits, said grouping suitable for further being accomplished by grooves in said free floating gears and by said sectors of said hydrostatic equilibrium on said plates at said level of said rolling circle.

10. The hydraulic generator receiver according to claim 9 wherein said flexible casing has recesses for receiving portions of said first and second plates corresponding to high pressure and low pressure orifices.

11. The hydraulic generator receiver according to claim 10 wherein on the periphery of said first and second plates there is a low pressure channel which is cleared by at least two conduits with non-return valves directed toward a low pressure zone to permit a good seal between said casing and said first and second plates.

12. The hydraulic generator receiver according to claim 11 wherein said mesh point of said free floating gears has a system of non-return valves suitable for linking said tooth spaces at said mesh point and said high pressure as well as said low pressure orifice to permit oil to be evacuated under pressure from said tooth spaces at said mesh point on said pressure side.

13. The hydraulic generator receiver according to claim 12 wherein each of said free floating gears has the same even number of teeth, the same toothing modulus, the same helix angle $\alpha$, wherein $tg\alpha=2H/\pi M$, and equilibrium circuits being separated by an angular distance equal to an angular step, $\pi$M, of said toothing, said equilibrium circuits having connecting means for connecting at least two diametrically opposed tooth spaces and perfect equilibrium is realized with an incompressible hydraulic fluid and with an unbalance in favor of a side containing said high pressure orifice, said free floating gears being pushed back toward a low pressure side of said orifice, except in the case of said grouping of said conduits.

14. The hydraulic generator receiver according to claim 12 wherein each of said free floating gears has the same odd number of teeth, the same toothing modulus, the same helix angle $\alpha$, wherein $tg\alpha=2H/\pi M$, and equilibrium circuits being separated by an angular distance equal to an angular step $\pi$ M of said toothing, said equilibrium circuits having connecting means for connecting two diametrically opposed tooth spaces with an offset of a half step always giving pressurization priority to a sector opposite a sector containing said high pressure orifice, perfect equilibrium being realized during a specific speed of rotation at least equal to the maximum permissible sped of rotation, as well as in favoring of a side opposite said high pressure orifice, said free floating gears being pushed back against said high pressure orifice, except in the case of said grouping of said conduits.

15. The hydraulic generator receiver according to claim 12 wherein each of said free floating gears has the same odd number of teeth, the same toothing modulus, the same helix angle $\alpha$, wherein $tg\alpha=2H/\pi M$, and equilibrium circuits being separated by an angular distance called an equilibrium step and equal to 360° divided by a number of teeth minus one and permitting successive closure of said different circuits with an angular offset corresponding to one rotation of $\pi M/Z-1$, said equilibrium circuits having connecting means for connecting at least two diametrically opposed tooth spaces with an offset of half step always giving pressurization priority to a sector opposite a sector containing said high pressure orifice, perfect equilibrium being realized during a specific speed of rotation at least equal to the maximum permissible speed of rotation at least equal to the maximum permissible speed of rotation, as well as in favoring a side opposite said high pressure orifice, said free floating gears being pushed back against said high pressure orifice, except in the case of said grouping of said conduits.

* * * * *